US006824221B1

(12) United States Patent
Tiffany, III et al.

(10) Patent No.: US 6,824,221 B1
(45) Date of Patent: Nov. 30, 2004

(54) FURNITURE

(75) Inventors: H. Robert Tiffany, III, Point Pleasant, PA (US); Barbara Yaseen Tiffany, Point Pleasant, PA (US)

(73) Assignee: Tiffany and Tiffany Designers, Inc., Point Pleasant, PA (US)

( * ) Notice: Subject to any disclaimer, the term of this patent is extended or adjusted under 35 U.S.C. 154(b) by 0 days.

(21) Appl. No.: 09/560,686

(22) Filed: Apr. 27, 2000

(51) Int. Cl.[7] ..... A47C 7/02; A47C 7/16

(52) U.S. Cl. ..... 297/452.63; 297/451.4; 297/451.8

(58) Field of Search ..... 297/452.63, 447.1, 297/451.8, 440.1, 25, 451.4, 440.14

(56) References Cited

U.S. PATENT DOCUMENTS

| | | | | | |
|---|---|---|---|---|---|
| D101,273 | S | | 9/1936 | Ferguson | |
| 2,798,538 | A | | 7/1957 | Dreifke | |
| 2,994,558 | A | * | 8/1961 | Draxler | 297/451.8 X |
| D198,128 | S | | 5/1964 | Poisson | |
| 3,743,353 | A | * | 7/1973 | Lupinsky | 297/118 |
| 3,834,759 | A | | 9/1974 | Panton | |
| D253,142 | S | | 10/1979 | Herman | |
| 4,235,473 | A | * | 11/1980 | Aginar | 297/452.63 X |
| 4,278,288 | A | * | 7/1981 | Thebaud | 297/451.8 X |
| 4,322,109 | A | * | 3/1982 | Thebaud | 297/25 |
| D341,263 | S | | 11/1993 | Gehry | |
| D344,191 | S | | 2/1994 | Gehry | |

* cited by examiner

*Primary Examiner*—Anthony D. Barfield
(74) *Attorney, Agent, or Firm*—Venable LLP; Jeffrey L. Eichen; Stuart I. Smith

(57) ABSTRACT

A furniture piece including a plurality of rib units, each-rib unit having a pair of substantially parallel faces, at least one functional surface, and a leg or supporting member. When arranged in a predetermined, face-to-face relationship and secured by one or more connecting rods, the functional surface of each rib unit defines a surface of a furniture piece, such as a chair or bench seat, while each leg or supporting member is offset from the neighboring leg or support member according to a pattern which, when combined with the legs or supporting members of the other rib units, provides support for the entire furniture piece and its occupant.

16 Claims, 5 Drawing Sheets

FURNITURE

BACKGROUND OF THE INVENTION

1. Field of the Invention

This invention relates to a piece of furniture, particularly one which is constructed out of a plurality of rib units, each rib unit having a pair of substantially parallel faces, at least one functional surface and a leg or supporting member so that, when arranged in a predetermined, face-to-face relationship and secured by means of one or more connecting rods, the functional surface of each rib unit defines a surface of a furniture piece, such as a chair or bench seat and back support, while each leg or supporting member is offset from the neighboring leg or support member according to a pattern which, when combined with the legs or supporting members of the other rib units, provides support for the entire furniture piece and its occupant.

2. Description of the Prior Art

There are numerous methods for the construction of furniture from rigid materials, such as wood, metal or plastic, and a similar multitude of furniture pieces characteristic of each method of construction. In particular, this invention relates to a type of furniture constructed from a series of repeating rib units linked or secured by means of one or more connecting rods Within this particular art, two prior patents may be of interest.

U.S. Pat. No. 4,235,473 discloses an item of furniture constructed form a series of rigid rib units and one or more connecting rods and spacers so that, when the rib units, connecting rods and spacers are arranged and secured in the correct order, the rib units form a functional surface, such as a chair seat or back, and a support structure to bear the weight of the furniture item and its occupant The '473 patent, however, discloses only one means for providing a sufficient support structure. According to the '473 patent, the support structure of the furniture is achieved by alternating between two or three different types of rib units, each of which has a configuration distinct from the other(s). When these two or three different types or configurations of rib units are arranged and secured in alternating fashion, the combined contributions of each type of rib unit are sufficient to support the entire weight of the chair or bench and its occupant(s). Note, however, that each of the rib units must be of sufficient width and strength, the gaps between rib units of sufficient narrowness, and the connecting rod of sufficient rigidity so that the supporting structure does not collapse when force is applied to the furniture in a direction which is both downward and perpendicular to the plane of the rib units. The '473 patent does not disclose any other means for achieving a sufficient supporting structure. such as one using narrower or more flexible rib units, a more flexible connecting rod, or only one type or configuration of rib unit.

Similarly, U.S. Pat. No. 3,834,759 discloses an item of furniture constructed from a series of rigid rib units made of wire and one or more connecting rods and spacers so that, when the rib units, connecting rods and spacers are arranged and secured, the rib units again form a rigid functional surface, such as a chair seat and back, and a support structure to bear the weight of the furniture item and its occupant. The '759 patent, however, also discloses only one means for providing a sufficient structure to support the weight of the furniture item and its occupant(s). According to the '759 patent, support for the rib units is achieved by using one or more curved connecting rods. The curvature of the connecting rods places each of the rib units in a vertical plane slightly differently from any of its neighbors. When arranged in this way, the resulting structure is better enabled to support forces which are directed downwards and toward the side of the chair, since any force directed both downwards and toward the side of the chair will not collapse the structure but instead will be supported by the rib units which are not perpendicular to the sidewards component of the force. In other words, the curvature of the connecting rods contributes significantly to the ability of the resulting structure to bear loads and forces when the item is used as a piece of furniture. Note, however, that, without the benefit of a curved connecting rod, the resulting structure would simply collapse when a sufficient force is applied in a direction which is both downward and toward the side of the chair, that is, perpendicular to the plane of the rib units The '759 patent does not disclose any other means for achieving a sufficient supporting structure, such as one using parallel (rather than radial) rib units.

It is an object of this invention to provide a piece of furniture constructed of a plurality of similarly configured rib units, one or more connecting rods and means for spacing and securing the rib units along the length of the connecting rod or rods.

It is a further object of this invention to provide an improved means for supporting the weight of the piece of furniture and its occupants without the use of two or three different types of rib units and without requiring the use of curved connecting rod5.

It is a further object of this invention to provide a piece of furniture which is easily manufactured, assembled and shipped, in that the piece of furniture is constructed primarily from rib units of a similar configuration.

Other objects will become apparent from the description of this invention, as described and claimed below.

DESCRIPTION OF THE INVENTION

1. Brief Summary of the Invention

The furniture piece comprises a plurality of rib units, each-rib unit having a pair of substantially parallel faces, at least one functional surface and a leg or supporting member so that, when arranged in a predetermined, face-to-face relationship and secured by means of one or more connecting rods, the functional surface of each rib unit defines a surface of a furniture piece, such as a chair or bench seat and back support, while each leg or supporting member is offset from the neighboring leg or support member according to a pattern which, when combined with the legs or supporting members of the other rib units, provides support for the entire furniture piece and its occupant.

2. BRIEF DESCRIPTION OF THE INVENTION

The invention will be further described in connection with the accompanying drawings, in which.

3. DETAILED DESCRIPTION OF THE DRAWINGS

Figure 1:
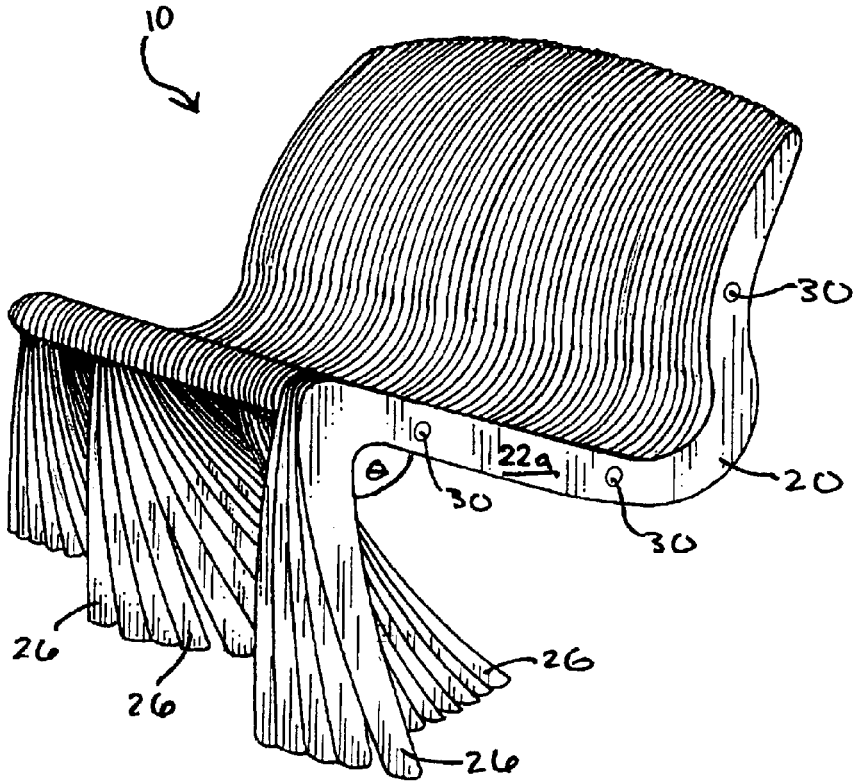
FIG. 1 is a front side perspective view of a furniture piece built in accordance with the present invention.
Figure 2:
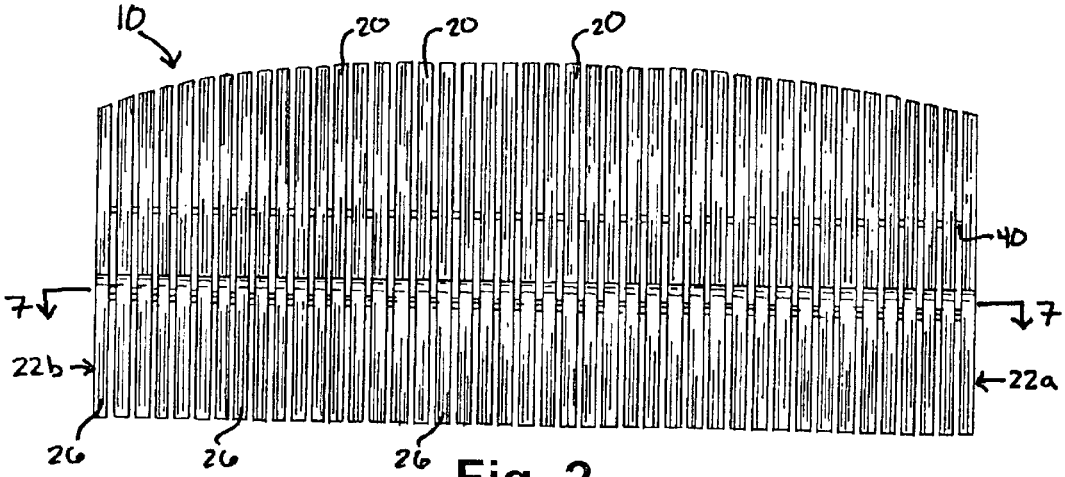
FIG. 2 is a front elevations view thereof.

Before explaining the invention in detail, it is to be understood that the invention is not limited in its application to the detail of construction and arrangement of parts illustrated in the drawings, since the invention is capable of other embodiments. It is also to be understood that the phraseology or terminology employed is for the purpose of description only and not of limitation. Moreover, the exact shape of the furniture piece and components thereof shown in the accompanying drawings is for the purpose of description only and not of limitation.

Referring to the drawings in which like parts are designated by the same number throughout the various figures, FIG. 1 shows a front side perspective view of a furniture piece 10 designed and constructed in accordance with the teachings of the present invention. The rib units 20 are constructed of any rigid material suitable for the purpose of making furniture, such as wood, metal or different types of plastic. The number and exact shape of the rib units 20 is not critical and is a matter of design choice. Each rib unit 20 is a substantially uniform thickness and presents two substantially parallel sides 22*a*, 22*b*, although these qualities are not critical to the invention and are also a matter of design choice.

Figure 3:
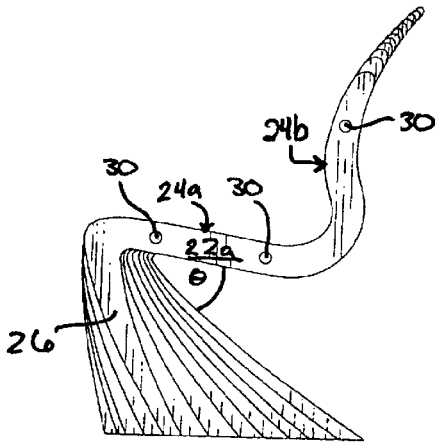
FIG. 3 is a left side elevational view thereof, the opposite side being a mirror image.

As shown in FIG. 1 in front side perspective view and in FIG. 3 in side elevational view, each rib unit 20 comprises at least one functional surface 24 and at least one supporting member 26. In the embodiment piece illustrated in these drawings, each rib unit 20 provides a seat surface 24*a*, a back support surface 24*b*, and a single supporting leg 26. The functional surfaces 24 of each of the rib units 20 are substantially identical, so that when they are secured in the proper face-to-face orientation, the functional surfaces of the combined rib units 20 define a chair seat and back support. Making the functional surfaces 24 of each of the rib units 20 substantially identical produces a furniture piece in which the functional surfaces 24 are flat in the direction perpendicular to the plane of the rib units 20, as shown in the illustrated embodiment. However, it is also possible to vary the shape of the functional surfaces 24 of each rib unit 20 slightly from one rib unit 20 to the next to produce a furniture piece 10 having a contoured or dished seating surface or back support. The exact shape of the functional surface 24 of each of the rib units 24 is not critical and is a matter of design choice. As will be apparent to one skilled in the art, the functional surface 24 of each rib unit 20 can be shaped to produce a number of furniture items, such as chairs, benches, loveseats, tables, beds and other items of furniture.

Figure 4:
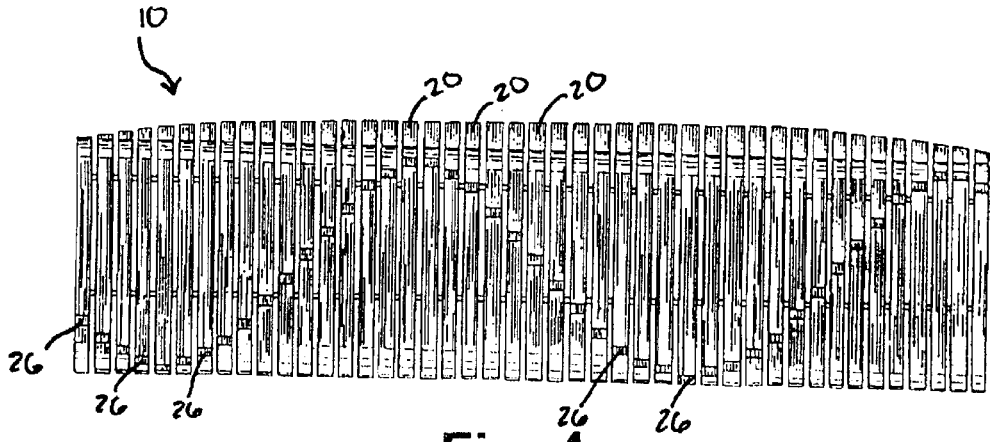
FIG. 4 is a bottom elevations view thereof.
Figure 5:
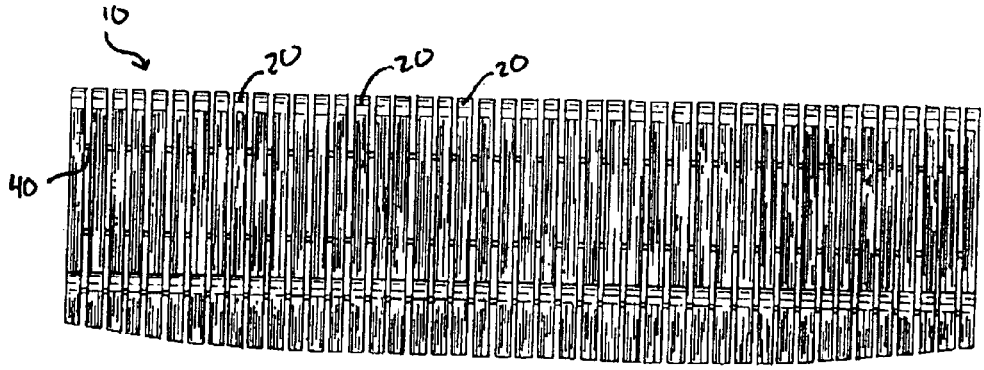
FIG. 5 is a top elevations view thereof.
Figure 6:
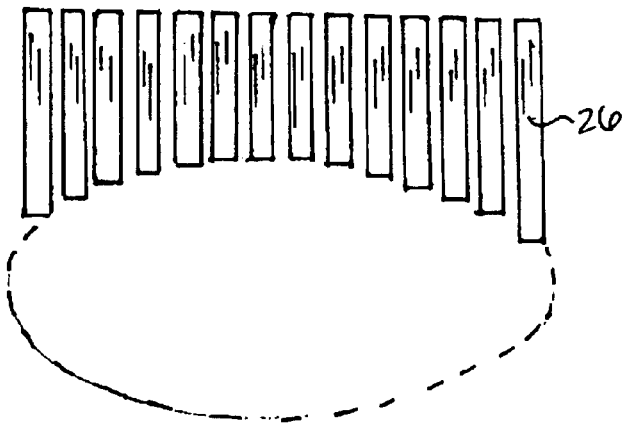
FIG. 6 is a cross-sectional view taken along line 7—7 of FIG. 2 of one embodiment of the invention, wherein support members define an eliptical pattern.
Figure 7:
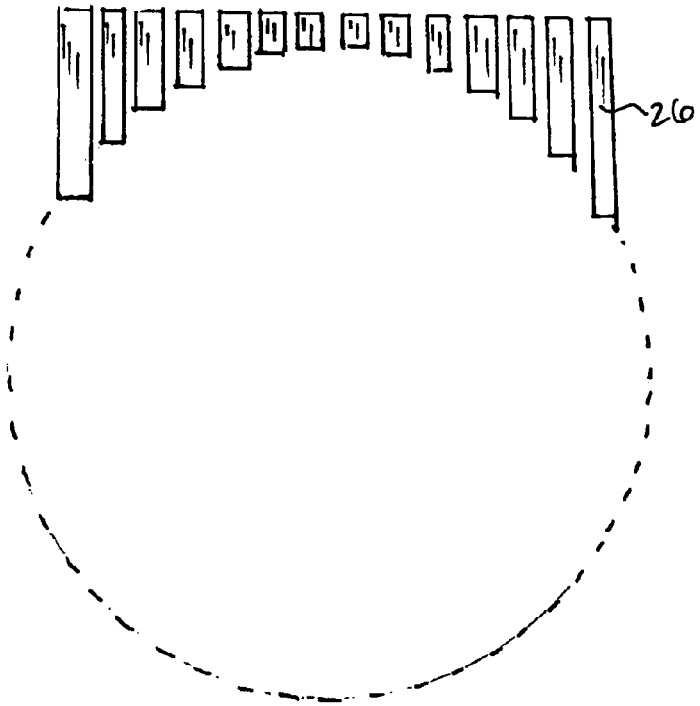
FIG. 7 is a cross-sectional view taken along line 7—7 of FIG. 2 of one embodiment of the invention, wherein support define a circular pattern.
Figure 8:
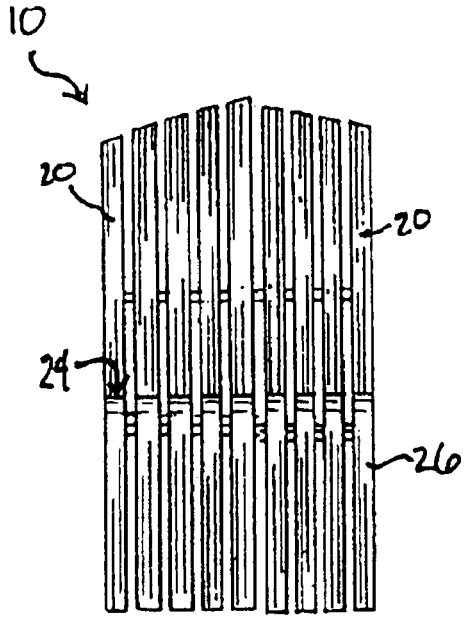
FIG. 8 is a front elevational view of a chair according to one embodiment of the invention.
Figure 9:
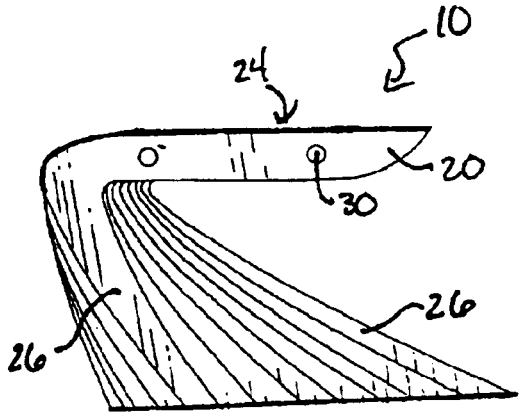
FIG. 9 is a side elevational view of a table according to one ebodiment of the invention.

In order to maintain the individual rib units 20 in a predetermined face-to-face relationship, there are provided one or more interconnecting means 30 and a plurality of spacer means 40. The interconnecting means 30 may be a simple rod, such as a dowel of wood, metal or plastic, passing through the individual rib units 20 and spacer means 40, in which case the rib units 20 and the spacer means 40 are provided with registered holes to admit the passage of the dowel, with the dowel being locked into position either by friction, adhesive or a conventional fastener such as nails or screws. Other interconnecting means 30 are possible, such as using one or more nuts and bolts, again passing through registered holes in the individual rib units 20 and spacer means 40. It is not necessary that the interconnecting means 30 pass through holes in the spacer means 40 but generally this is desirable for esthetic reasons. The spacer means 40 may be one or more pieces of substantially any shape and material which are of a size sufficient to be placed between each of the individual rib units 20 and keep the individual rib units 20 spaced apart when the rib units 20 are interconnected. Alternatively, the spacer means 40 may be a part of the rib unit 20 or interconnecting means 30, such as a plurality of grooves, notches or teeth situated along the length of the interconnecting means and shaped to lock each of the individual rib units 20 into a particular location along the interconnecting means. As will be apparent to one skilled in the art, a number of different means for interconnecting and spacing the individual rib units are possible using presently available methods There is also shown in FIGS. 1 and 4 a supporting leg 26 for each rib unit 20. The supporting leg or member 26 associated with each rib unit 20 is offset in position from the neighboring leg or member 26 according to a pattern which, when combined with the legs or members 26 of other rib units 20, provides support for the entire piece of furniture and its occupant. In particular, FIG. 4 shows the bottom of each supporting leg or member 26 forming a curving, approximately sinusoidal pattern along the length of the furniture piece. This pattern is achieved by varying the angle formed between the supporting member 26 of each of the rib units 20 and the floor. Besides the pattern illustrated, other patterns are possible which provide the support necessary to bear the weight of the piece of furniture and its occupant(s), if any. The exact shape of the supporting legs or members 26of each of the rib units 20 is not critical and is a matter of design choice. As will be apparent to one skilled in the art, the supporting legs or members 26 can be arranged in a number of different patterns which are suited to supporting the weight of the furniture and its occupant.

It will be apparent that the foregoing method of construction is well suited to mass production since the individual rib units of each furniture piece can be produced in large quantities and interchanged. It will also be apparent to those skilled in the art that the foregoing method of construction of a piece of furniture is well suited to producing a low volume shipping package, since the rib units can be disassembled and shipped in flat package by nesting the rib units against each other.

It is also apparent that numerous modifications of this construction technique can be employed in order to define and construct a wide variety of furniture pieces. In particular, the furniture piece illustrated herein is a bench and has been presently solely for the purposes of exemplification. However, there are numerous other furniture items which can be constructed in accordance with the teachings of this invention, such as a chair, a table, a stool, a bed and other items, without departing from the spirit of the invention.

Although a detailed description of the invention has been provided, it is not intended that such details be limitations upon the scope of the invention. It will be obvious to those skilled in the art that various modifications and substitutions may be made without departing from the spirit and scope of the invention as set forth in the following claims.

What is claimed is:

1. A furniture piece, which comprises:

a plurality of rib units, each rib unit having at least one functional surface having at most one supported end, and at most one supporting member, the supporting member having a first end and a second end, the first end of the supporting member being contiguously attached to the functional surface at the supported end, and the second end of the supporting member extending downwardly from the supported end; and interconnecting means for securing each of the rib units to at least one other of the rib units, wherein a composite of the functional surfaces of the rib units defines one or more surfaces of the furniture piece, the first end of the supporting member of each rib unit is immediately adjacent to the first end of the supporting member of at least one other of the rib units, and the second end of the supporting member of each rib unit is closer to the second end of the supporting member of an adjacent one of the rib units than to the second end of the supporting member of any non-adjacent one of the rib units.

2. The furniture piece of claim 1 in which at least one functional surface defines a seating surface.

3. The furniture piece of claim 1 in which at least one functional surface defines a tabletop surface.

4. The furniture piece of claim 1 in which each rib unit has two functional surfaces, one functional surface defining a seating surface and one functional surface defining a back support surface.

5. The furniture piece of claim 1 further comprising a spacer between each adjacent rib unit.

6. The furniture piece of claim 1 wherein each rib unit includes a portion of each functional surface.

7. The furniture piece of claim 1 wherein each supporting member is fixed at a substantially consistent point on each rib unit.

8. The furniture piece of claim 1 wherein the rib units are made of plastic.

9. The furniture piece of claim 1 wherein the rib units are made of metal.

10. The furniture piece of claim 1 wherein the functional surface of each rib unit has one and only one supported end.

11. The furniture piece of claim 10 wherein each rib unit has one and only one supporting member.

12. The furniture piece of claim 1 wherein each rib unit has one and only one supporting member.

13. The furniture piece of claim 1 wherein the second ends of the supporting members are the only portions of the furniture piece that are for contacting a supporting surface on which the furniture piece is placed in use.

14. The furniture piece of claim 1 wherein a total load of the furniture piece is supported by the second ends of the supporting members.

15. A furniture piece, which comprises:

a plurality of rib units having at least one functional surface and a single supporting member; and interconnecting means for securing each of the rib units to one or more of the other rib units, wherein a composite of the functional surfaces of the rib units defines one or more surfaces of the furniture piece, each supporting member emanates consistently downward among the rib units from the same side of the furniture piece; and each supporting member is fixed at an angle to a functional surface wherein the angle varies from one rib unit to another such that a composite of the supporting members provides support for the furniture piece and its load.

16. The furniture piece of claim 15 in which the angle between the supporting member and a functional surface varies from one rib unit to another such that a composite of the supporting members forms a sinusoidal pattern.

* * * * *